United States Patent [19]

Kurata

[11] Patent Number: 4,556,000

[45] Date of Patent: Dec. 3, 1985

[54] NEEDLE STRUCTURE FOR TUFTING MACHINE

[75] Inventor: Yoshiharu Kurata, Mie, Japan

[73] Assignee: Nakacawa Seisakusho Co., Ltd., Agei, Japan

[21] Appl. No.: 585,133

[22] Filed: Mar. 1, 1984

[30] Foreign Application Priority Data

Mar. 8, 1983 [JP] Japan ..... 58-33259[U]

[51] Int. Cl.[4] ..... D05B 85/00

[52] U.S. Cl. ..... 112/222; 112/79 R; 112/226

[58] Field of Search ..... 112/79 R, 222–226

[56] References Cited

U.S. PATENT DOCUMENTS

| | | | |
|---|---|---|---|
| 2,619,059 | 11/1952 | Rosenfeld | 112/222 |
| 4,157,690 | 6/1979 | Lund et al. | 112/226 |
| 4,170,949 | 10/1979 | Lund | 112/226 X |
| 4,329,934 | 5/1982 | Hanyu et al. | 112/226 |

*Primary Examiner*—Ronald Feldbaum

*Attorney, Agent, or Firm*—Moonray Kojima

[57] ABSTRACT

Needles for constituting the needle bar of the tufting machine. Each of needles provides at the base portion of the needle shaft with a chamfered portion which is brought into contact in a face-to-face relationship with a face of grooves which are formed in a gauge plate for receiving and securing the needles therein, respectively.

3 Claims, 7 Drawing Figures

II
II
1
2
3
4
5
10
11

1
2
4
5
6
7
9
11

1
3
4
5
5'
6
7
8
10
11

1
2
3
4
5
6
7
8
9
10
11
P

NEEDLE STRUCTURE FOR TUFTING MACHINE

BACKGROUND OF THE INVENTION

The present invention relates to a needle structure for a tufting machine, and more particularly, to a needle structure for use in the needle bar of a tufting machine.

Since the base portions of the needle shafts conventionally have round shapes, there are inconveniences that the arrangement of the needles is not fixed uniformly because of shortages of the skill or care of the workers when the needles are inserted into grooves of the gauge plate of the needle bar, and that the needles may slightly turn in the grooves when the gauge plate is fastened to secure the needles therein by means of the screws so that the arrangement of the needles becomes irregular.

Especially when the grooves of the gauge plate have V-shaped or angled shapes, the needles are inserted and fixed at best in a line-to-line relationship with the walls of the grooves. This makes it impossible to completely eliminate the defects thus far described and invites a fear that the arrangement of the needles is disturbed by the vibrations in the operation even if the needles are accurately inserted and set in the grooves.

SUMMARY OF THE INVENTION

An object of the present invention is to provide needles to be inserted into angled grooves of a gauge plage and to be fixed in accurate, uniform and stable states in the grooves.

According to the present invention, a needle bar base is constructed of such pieces as can be connected in a longitudinal direction along a needle bed, in which each of said pieces of formed in its upper face with a rectangular groove extending in the longitudinal direction and having a larger width than the diameter of the needles, a gauge plate has angled grooves which are formed at an interval corresponding to the pitch of needles to be inserted therein, and needles which have their base portion formed on their surfaces with such a chamfered portion as to contact in a face-to-face relationship with the angled grooves are inserted and are set in the grooves by means of screws.

DETAILED DESCRIPTION OF THE INVENTION

The present invention will now be illustrated referring to the accompanying drawings.

Figure 1:
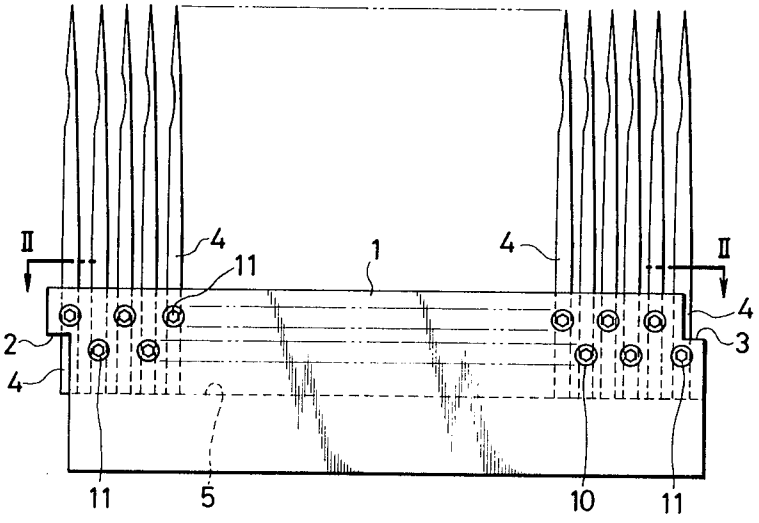
FIG. 1 is a front elevation showing a needle bar.

First of all, the construction of the needle bar will be described. FIG. 1 is a front elevation of a single unit constructing the needle bar. Indicated at reference numeral 1 in FIG. 1 is a piece of the needle bar which has a rectangular section and a length of 10 to 15 cm. The piece 1 is formed with a downward stepped portion 2 at its lefthand upper portion and with an upward stepped portion 3 at its righthand end. Thus, a needle bar base of a desired length can be constructed such that the pieces are connected in the longitudinal direction of the needle bar while engaging with each other at their stepped portions 2 and 3.

Figure 3:
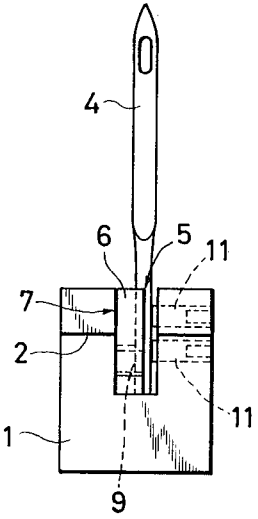
FIG. 3 is a lefthand side elevation of FIG. 1.
Figure 4:
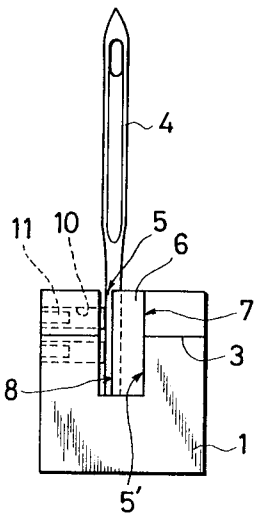
FIG. 4 is a righthand side elevation of the same.
Figure 2:
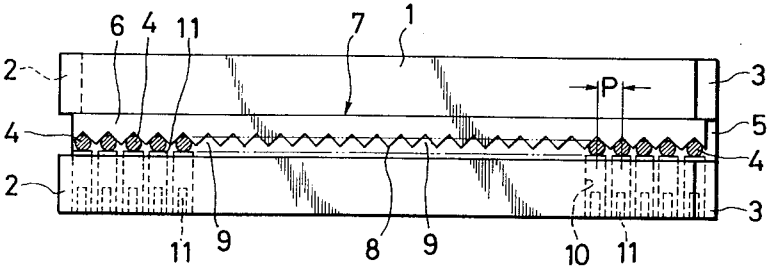
FIG. 2 is a section taken along line II—II of FIG. 1.

FIG. 2 is a sectional view showing the needle bar unit and taken along line II—II of FIG. 1, and FIGS. 3 and 4 are lefthand and righthand side views of the same, respectively. As is apparent from those Figures, the aforementioned piece 1 is formed in its upper face with a generally -shaped rectangular groove 5 which has a width a few times as wide as the diameter of needles 4 and which is made so deep as to receive the base portions of the needle shafts without fail. The width and depth of the rectangular groove 5 are formed to be equal in the longitudinal direction. Indicated at numeral 6 is a gauge plate which is inserted into the rectangular groove 5 throughout the length thereof and sets the needles 4 in the groove 5. The gauge plate 6 provides with one face 7 longitudinally extending therealong, which is coming in contact with a groove wall 5' and provides with another face 8 on which grooves 9 for receiving the base portions of the needle shafts are formed. Each of the grooves 9 has an angled section (which is shown in V-shaped form in FIG. 2) and the grooves are arranged at an interval P corresponding to the pitch of the needles 4 for holding the needles one by one.

After the gauge plate 6 formed with the aforementioned grooves 9 is fitted in the rectangular groove 5 of the piece 1, the needles 4 are inserted one by one into the grooves 9 and are respectively fastened by means of screws 11, which are driven into tapped holes 10 formed through the front face of the piece 1 toward the rectangular groove 5, so that the needles 4 are prevented from coming out from the rectangular grooves 5 together with the gauge plate 6.

Figure 5:
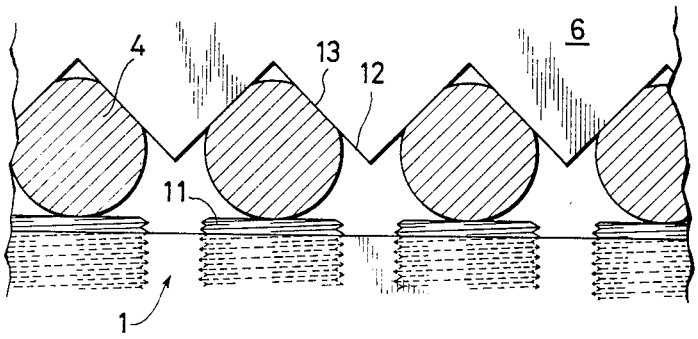
FIGS. 5 and 6 are partially enlarged sectional views of FIG. 2 and show the states in which the needles of the present invention are inserted into the grooves of the gauge plate.
Figure 6:
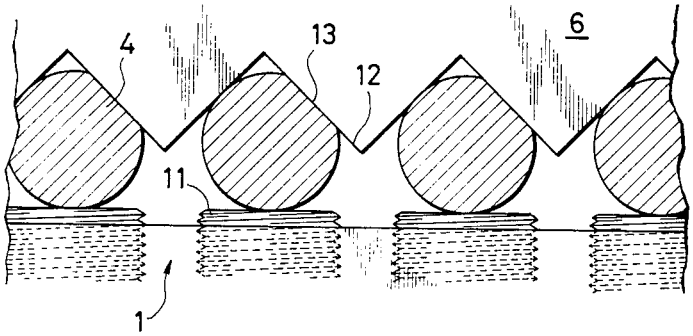

Here, each of the needles 4 according to the present invention is formed, as shown in FIGS. 5 and 6, with such a chamferred portion or portions 13 as to contact in a face-to-face relationship with the groove face or faces 12 of the corresponding groove 9 on the surface of its base portion which is to be inserted into the angled groove 9 (which is V-shaped in FIGS. 5 and 6) of the aforementioned gauge plate 6. FIG. 5 shows the case in which each needle 4 has its base portion formed with two chamferred portions to contact in a face-to-face relationship with the two groove faces of the V-shaped groove. FIG. 6 shows the case in which each needle 4 has its base portion formed with one chamferred portion to contact in a face-to-face relationship with the one groove face of the V-shaped groove.

Figure 7:
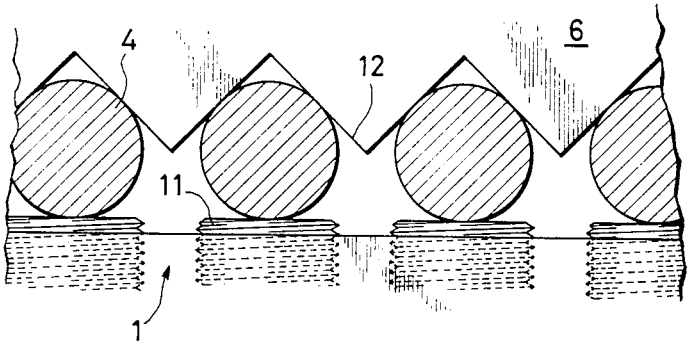
FIG. 7 is an enlarged sectional view of the same portion and shows the state in which the needles of the prior art are inserted into the grooves of the gauge plate.

According to the prior art, however, the needle 4 has its base portion shaped to have a round section, as shown in FIG. 7, so that it contacts at best in line-to-line relationship with the groove faces of the corresponding groove (which is shown to have a V-shaped form) because its base portion has a round section, as shown in FIG. 7. This invites phenomena that the needles are irregularly arranged when they are inserted, and that the needles are finely turned to have irregular arrangements when they are fastened by means of the screws 11. Even if the needles are accurately inserted and fixed, moreover, there also arises a fear that the arrangements of the needles are changed by the vibrations of the operation. As has been described hereinbefore, however, the needle structure according to the present device is made such that the base portion of the needle shaft is formed on its surface with the chamferred portion or portions which is or are brought into face-to-face contact with the angled grooves of the gauge plate for receiving the needles. As a result, it is possible to eliminate the fear that the needles are inserted in erroneous arrangements into the grooves and to prevent the needles from being slightly turned by the fastening operations of the needles by the screws or by the vibrations in the operation. Thus, all the needles can be inserted and fixed in alignment in a predetermined direction in the grooves of the gauge.

In the description thus far made with reference to the accompanying drawings, incidentally, the angled vertical grooves of the gauge plate have the V-shaped forms, for example, but they should not necessarily be limited to those forms. In short, there arises no difficulty with the grooves of another angled shape such as a square or trapezoidal shape, if the chamfered portion of the needle base portion contacts in the face-to-face relationship with at least one face of the corresponding groove of the gauge. By preparing the gauge plate formed with angled grooves having a variety of shapes, it is made possible to insert only the needles having the corresponding chamferred portion or portions. This raises an advantage that needles of different kinds can be prevented from being erroneously inserted into the gauge plate.

What is claimed is:

1. A needle structure for a tufting machine, wherein needles are inserted into and fixed in grooves formed on a face of a gauge plate to constitute a needle bar, characterized in that each of the needles provies at the base portion of the needle shaft with at least one chamfered portion which is brought into contact in a face-to-face relationship with one of the faces of the groove which is formed in the gauge plate for receiving the corresponding base portion of the needle shaft, wherein said gauge plate has angled grooves which are formed at an interval corresponding to the pitch of needles to be inserted therein and to constitute the needle bar, and wherein each of said angled grooves has a V-shaped section, and wherein one chamfered portion is formed on the base portion of the needle shaft and is brought into contact with one of the faces of the V-shaped groove.

2. A needle structure as claimed in claim 1, wherein two chamfered portions are formed on the base portion of the needle shaft and are brought into contact with the faces of the V-shaped groove, respectively.

3. A needle structure as claimed in any of the preceding claims, wherein said needles and said gauge plate are fitted into a rectangular groove which is formed in a needle bar base to extend along the longitudinal direction of the needle bar, said needles are such arranged that the chamcered portions of the needles are brought into contact in a face-to-face relationship with a face of the gauge plate, and said needles are respectively fastened by means of screws together with the gauge plate toward one of the walls of the rectangular groove to construct the needle bar unit.

* * * * *